United States Patent [19]

Kobayashi et al.

[11] 4,262,645

[45] Apr. 21, 1981

[54] INJECTION TIMING CONTROL DEVICE FOR DISTRIBUTOR-TYPE FUEL INJECTION PUMP

[75] Inventors: Masayoshi Kobayashi; Toru Sakuranaka; Keiichi Yamada, all of Higashi-matsuyama, Japan

[73] Assignee: Diesel Kiki Co., Ltd., Tokyo, Japan

[21] Appl. No.: 41,491

[22] Filed: May 22, 1979

[30] Foreign Application Priority Data

Jun. 16, 1978 [JP] Japan ..... 53-073538

[51] Int. Cl.[3] ..... F02M 59/20; F02M 59/32

[52] U.S. Cl. ..... 123/502; 123/179 L; 123/501

[58] Field of Search ..... 123/139 AQ, 139 AP, 123/139 ST, 179 L, 140 RC

[56] References Cited

U.S. PATENT DOCUMENTS

| | | | |
|---|---|---|---|
| 2,910,925 | 11/1959 | Evans | 123/139 AQ |
| 3,906,916 | 9/1975 | Laufer | 123/139 AQ |
| 3,951,117 | 4/1976 | Perr | 123/139 AQ |
| 3,968,779 | 7/1976 | Davis | 123/139 AQ |
| 4,037,573 | 7/1977 | Swift | 123/179 L |
| 4,052,971 | 10/1977 | Salzberger | 123/139 AQ |
| 4,074,667 | 2/1978 | Skinner | 123/139 AQ |
| 4,122,813 | 10/1978 | Barnert | 123/179 L |

FOREIGN PATENT DOCUMENTS

| | | | |
|---|---|---|---|
| 2600222 | 4/1977 | Fed. Rep. of Germany | 123/139 AQ |
| 993888 | 6/1965 | United Kingdom | 123/139 ST |

*Primary Examiner*—Ronald H. Lazarus
*Assistant Examiner*—Carl Stuart Miller
*Attorney, Agent, or Firm*—Frishauf, Holtz, Goodman & Woodward

[57] ABSTRACT

An injection timing control device for use in a distributor-type fuel injection pump for internal combustion engines, which comprises: first and second hydraulic actuatable elements adapted to be actuated by a fluid pressure proportional to engine r. p. m., the second element having a larger pressure applying area than the first element and disposed on an extension of the axis of the first element; a first spring interposed between the first and second elements for urging the elements in opposite directions to each other; a second spring for urging the second element in an opposite direction to the first element; means for limiting displacement of the second element toward the first element; and means coupling the first and second elements for relative movement thereof within a limited distance. The elements and springs are so designed and arranged that the first element is displaced in an injection-timing-advancing direction during starting of an associated engine, while during the regular operation of the engine an ordinary timing advancing operation is carried out.

5 Claims, 3 Drawing Figures

INJECTION TIMING CONTROL DEVICE FOR DISTRIBUTOR-TYPE FUEL INJECTION PUMP

BACKGROUND OF THE INVENTION

The present invention relates to an injection timing control device for use in a distributor-type fuel injection pump for internal combustion engines.

A distributor-type fuel injection pump is conventionally provided with an injection timing control device for automatically advancing the injection timing in accordance with the increase of the engine r.p.m.

In internal combustion engines such as a diesel engine, it is necessary to advance the injection timing on and immediately after starting of the engine for obtaining smooth startablility of the engine. However, automatic advance of the injection timing is not available with a conventional type injection timing control device during starting of the engine. Therefore, conventionally a manual injection timing control device is separately provided for advancing the injection timing during starting of the engine. This, however, imposes a rather complicated and delicate starting operation upon the operator, making it difficult to obtain an accurate advance in the injection timing during starting of the engine.

OBJECT AND SUMMARY OF THE INVENTION

The present invention has been made in view of the abovementioned circumstances, and it is a primary object of the invention to provide an injection timing control device adapted for use in a distributor-type fuel injection pump for internal combustion engines, which is capable of obtaining an advance in the injection timing even during the starting of the engine, as well as carrying out injection timing control in response to changes in the engine r.p.m. during the regular operation of the engine.

The injection timing control device according to the invention comprises: a first hydraulic actuatable element with a prescribed pressure applying area, connected to a semi-fixed element disposed in end-face cam engagement with a rotary element which is coupled to a pump plunger for rotation at speeds in dependence on engine r.p.m.; a second hydraulic actuatable element with a larger pressure applying area than said first element, disposed on an extension of the axis of said first element; means for allowing relative movement of said first and second elements to each other within a prescribed distance and forcing the two elements to move in unison with each other over said prescribed distance; a first spring interposed between said two elements for urging them in opposite directions with respect to each other; means for prohibiting displacement of said second element toward said first element over a prescribed range; a second spring having one end fixed and the other end urging said second element in a direction opposite to said first element; and a pressure source for applying a fluid pressure proportional to engine r.p.m. to the pressure applying areas of said first and second elements, wherein the device is designed so as to satisfy the following relationships simultaneously:

$$P(A_2-A_1)>KS$$

and $$PA_1 \geqq F$$

where $A_1$=pressure applying area of said first hydraulic actuatable element, $A_2$=pressure applying area of said second hydraulic actuatable element, P=pressure acting upon the pressure applying areas of said first and second elements, S=maximum allowable displacement of said second element, F=setting load of said first spring, and K=spring constant of said second spring.

The above and other objects, features and advantages of the invention will become more apparent from a reading of the ensuing detailed description and the accompanying drawings.

DETAILED DESCRIPTION

Figure 1:
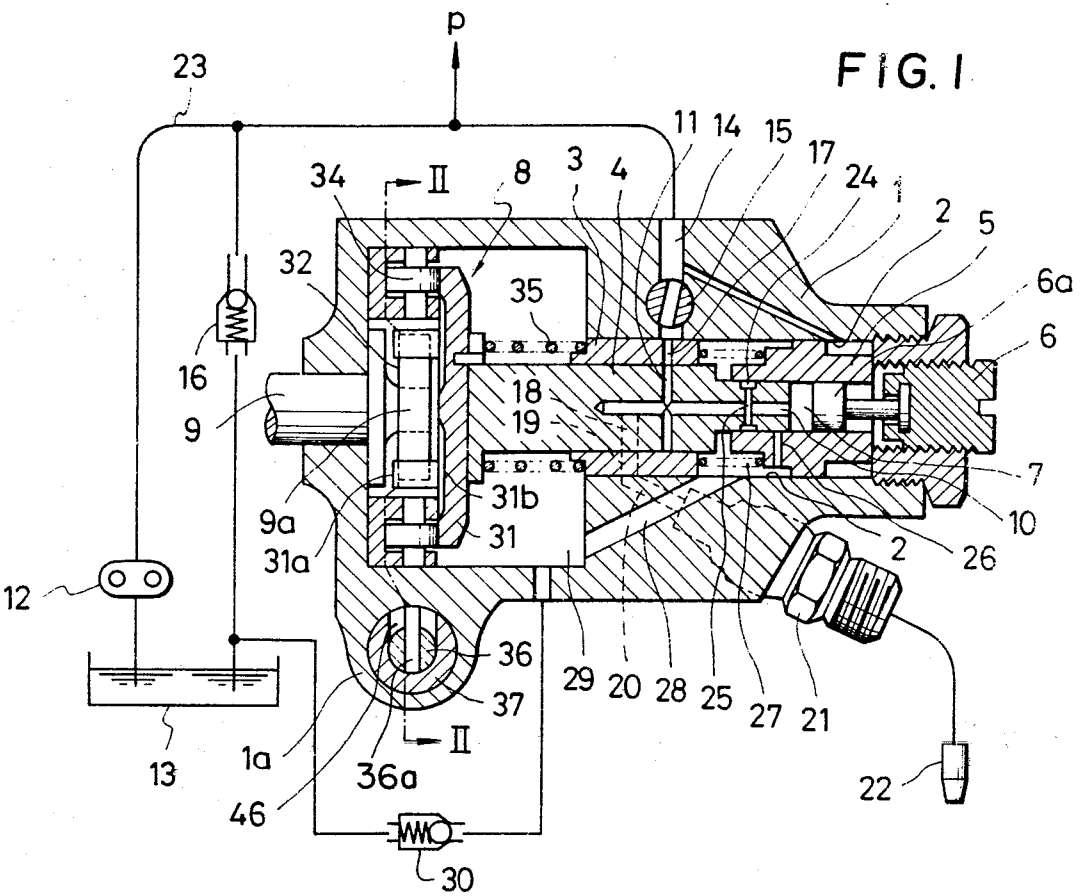
FIG. 1 is a longitudinal sectional view of a distributor-type fuel injection pump which is provided with an injection timing control device according to an embodiment of the invention.
Figure 2:
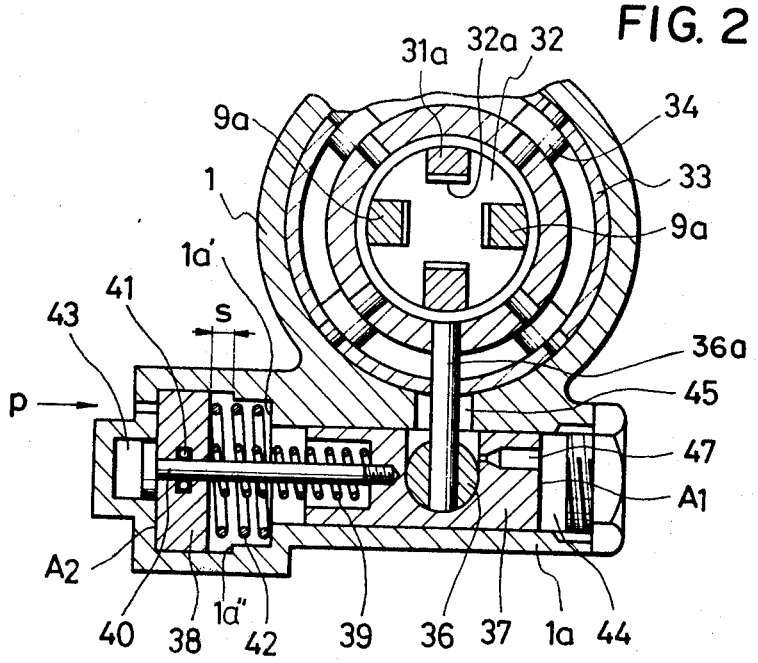
FIG. 2 is a fragmentary sectional view, partly broken away, taken along line II—II in FIG. 1.

FIGS. 1 and 2 illustrate a preferred embodiment of the invention. Referring first to FIG. 1, a distributor-type fuel injection pump will be roughly described to which the injection timing control device of the invention is applied. A pump housing 1 is formed with a through bore 2 in which a plunger barrel 3 is fitted. A plunger 4 is slidably fitted in the plunger barrel 3 so as to carry out rotative and reciprocating motions for pumping and distribution of fuel to the cylinders of an associated engine, as hereinafter described. Also fitted in the through bore 2 is a cut-off barrel 5 in which a plug 6 carrying a full load stopper **6*a* is fitted. The plunger barrel 3, the plunger 4 and the stopper 6*a* cooperate to define a pumping chamber 7. Secured to the left end of the plunger 4 is a cam assembly 8 to which a rotary shaft 9 is coupled which is connected to the output shaft of an associated engine, not illustrated. The plunger 4 is provided with an axial bore 10 extending from the right end face thereof and terminating in the interior thereof, and is also provided with a radial bore 11 intersecting with the axial bore 10 and opening in the peripheral lateral surface of the plunger 4. These bores 10, 11 are arranged to define a passage for fuel supplied by a feed pump 12, in cooperation with a passage 14 formed in the housing 1 and an inlet port 17 formed in the plunger barrel 3, when the plunger 4 comes to a prescribed position during its reciprocating and rotative stroke. Fuel is sucked from a fuel tank 13 and is pressurized by the feed pump 12 which is arranged to be driven at speeds proportional to the engine r.p.m. The pressurized fuel is supplied into the pump block via a feed pipe 23 and the passage 14, and then via a metering valve 15 which is adapted to vary the area of the fuel feeding passage so as to supply a required quantity of fuel to the pump block. The feed pump 12 is so designed that the quantity of fuel fed under pressure by the feed pump 12 is always larger than a required quantity, excessive fuel is returned into the tank 13 via a regulating valve 16 communicating with the pipe 23**. Accordingly, the pressure under which fuel is supplied to the pump block via the metering valve changes in proportion to the engine r.p.m.

The fuel which has passed the metering valve 15 travels in the passage 17 formed in the plunger barrel and the passages 11, 10 in the plunger 4, into the pumping chamber 7. The fuel thus introduced into the pumping chamber 7 is compressed as the plunger 4 moves rightward during the rotative and reciprocating motions thereof which are carried out by measures as hereinafter described. When a radial port 18 formed in the plunger 4 in communication with the axial bore 10 comes across an outlet port 19 formed in the plunger barrel 3, the fuel in the pumping chamber 7 is delivered under pressure through a passage 20 formed in the pump housing 1 and a delivery valve 21, to be injected into a cylinder of the associated engine, not illustrated, through an injection nozzle 22 connected to the delivery valve 21.

The peripheral lateral surface of the right end portion of the plunger 4 is formed with an annular groove 24 communicating with the axial bore 10 via a passage 25, while on the other hand a radial passage 26 is formed in a prescribed place of the cut-off barrel such that one stroke of fuel injection terminates when the annular groove 24 encounters the cut-off port 26. Then, the fuel in the pumping chamber 7 flows into the annular groove 24 and the port 26 and then into a space 27 defined by a surface of the plunger 4, opposed faces of the plunger barrel 3 and the cut-off barrel 5, and an inner wall of the through bore 2. The fuel then flows in a passage 28 formed in the pump housing 1 into a suction chamber 29 formed within the same housing 1, and thereafter is returned into the tank 13 via an overflow valve 30.

The mechanism for causing rotative and reciprocating motions of the plunger 4 is composed of a kind of Oldham's coupling which is constructed as follows. A coupling plate 32 is provided which has four holes **32*a* formed at circumferentially equal intervals. The drive shaft 9 arranged for rotation in dependence on the engine r.p.m. has two claws 9*a* formed diametrically oppositely on an end thereof and inserted in two holes 32*a*, while simultaneously the others of the holes 32*a* receive two claws 31*a* formed diametrically oppositely on a cam disc 31 which is secured to an end of the plunger 4, thus coupling the drive shaft 9 and the cam disc 31 to each other in such a manner that the positional relationship between the two members remains constant with respect to the rotational or circumferential direction and is variable with respect to the axial direction. The cam disc 31 has a cam surface 31*b* provided with highs corresponding in number to the number of the cylinders of the associated engine. The cam surface 31*b* is disposed in urging contact with rollers 34 carried by a roller holder 33 as hereinafter described, by means of a spring 35 interposed between the plunger 4 and the plunger barrel 3, so that the cam disc 31 is caused to make rotative motions and simultaneously reciprocating motions through a predetermined stroke by means of the rotation of the drive shaft 9. Thus, the plunger 4 rigidly coupled to the cam disc 31** is allowed to make rotative motions for distribution of fuel to the individual cylinders of the engine and reciprocating motions for suction and pressure feeding of fuel, at the same time.

The roller holder 33 consists of an annular semi-fixed member which has a peripheral edge of U-shaped cross section rotatably supporting the rollers 34 at opposite ends thereof. The roller holder 33 is disposed in the pump housing 1, concentrically with the drive shaft 9. A lever **36*a* is provided, with one end engaging with the roller holder 33 and the other end engaging, via a ball 36, with a piston 37 disposed within a housing 1*a*** for the injection timing control device, which acts as a first hydraulic actuatable element.

Disposed on an extension of the axis of the piston 37 is another piston 38 serving as a second hydraulic actuatable element having a diameter larger than that of the piston 37, which is slidably disposed within the housing **1*a*. The piston 38 is engages with the piston 37 through a rod 40 having a larger end 40 serving as a limiter, with a first spring 39 interposed between the two pistons so as to apply a prescribed setting load upon them. The rod 40 and the psiton 38 are adapted to slide on each other, and the sliding part between the rod 40 and the piston 38 is provided with an 0 ring 41 for keeping a liquid tight state therebetween. A second spring 42 is mounted within the housing 1*a* with a prescribed setting load, in a manner having one end engaged by a notch 1*a*' formed at a prescribed place in the housing 1*a*. Hydraulic pressure chambers 43, 44 are formed, respectively by the end faces of the pistons 38, 37 opposite to the end faces thereof facing the springs 39, 42, into which chambers fuel is introduced under pressure P. The pressurized fuel is supplied, for instance, from the suction space 29 where a fuel pressure proportional to the pump r.p.m. prevails, through a passage 45 formed in the housing 1, and through a passage restriction 46 formed in the housing 1*a* and a passage restriction 47 formed in the piston 37 to act upon the pressure applying surfaces of the pistons 38, 37, respectively. Thus, the position of the piston 37 and accordingly the circumferential position of the roller holder 33 connected thereto via the lever 36*a*** are determined in dependence on the value of the pressure P.

The injection timing control device is designed so as to satisfy the following relationships at the same time:

$$P(A_2-A_1)>KS$$

and $$PA_1 \geqq F$$

where $A_1$=area of the pressure applying surface of piston 37, $A_2$=area of the pressure applying surface of piston 38, P=pressure acting upon the pressure applying areas of pistons 37, 38, S=maximum allowable displacement of piston 38, F=setting load of spring 39, and K=spring constant of spring 42.

A change in the circumferential position of the roller holder 33 causes a corresponding change in the point of contact between the roller 34 and the cam surface of the cam disc 31, so that there occurs a change in the positional relationship between the circumferential phase of the drive shaft 9 and said point of contact, that is, the axial operative position of the plunger 4, thus varying the injection timing with respect to the rotation of the drive shaft 9. In the illustrated embodiment, it is so arranged that a leftward displacement of the piston 37 against the force of the spring 39 as viewed in FIG. 2 causes an advance in the injection timing.

The operation of the injection timing control device according to the invention constructed as above will now be described.

Figure 3:
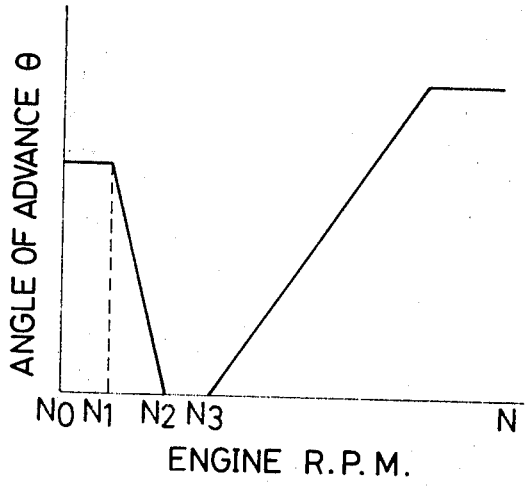
FIG. 3 is a graph showing a timing advance characteristic obtained by the injection timing control device according to the invention.

In Fig. 2, when the associated engine has just started, almost no fuel pressure is produced by the feed pump 12 and accordingly almost no fuel pressure is present in the chambers 43, 44, so that the piston 38 is urged leftward by spring 42 as viewed in FIG. 2. Simultaneously, the piston 37 is biased in its leftmost portion by the piston 38 via the rod 40. This situation corresponds to a rotational speed $N_0$ in the graph of FIG. 3 indicating the relationship between the rotational speed N and the angle of advance $\theta$. It is noted that at this speed $N_0$ the injection timing is already advanced by a certain amount.

After the engine has reached a state where all the cylinders of the engine are ignited, and has reached a rotational speed of $N_1$, a corresponding increase in the fuel feeding pressure causes a rightward displacement of the piston 38 against the force of the spring 42 so that a stroke S is executed at a rotational speed $N_2$ with the angle of advance reduced to zero. Then, even with a further increase in the rotational speed, the piston 38 which is now engaged by a notch 1*a*″ formed in the housing 1*a*, is no more displaced. After that, when a rotational speed $N_3$ is reached, a fuel pressure introduced into the chamber 44 causes the piston 37 to be displaced leftward against the force of spring 39, thus again carrying out a timing advance. The timing advancing action at higher rotational speeds than $N_3$ is carried out in a similar manner to the conventional timing advancing action. The widths between rotational speeds $N_0$ and $N_1$, and between $N_2$ and $N_3$ are determined by the setting loads of the springs 42, 39.

As set forth above, according to the present invention, it is feasible to automatically obtain an accurate advance in the fuel injection timing during the starting of the engine.

While a preferred embodiment of the invention has been described, variations thereto will occur to those skilled in the art within the scope of the present inventive concepts which are delineated by the following claims.

What is claimed is:

1. In a fuel injection pump for internal combustion engines of the type including a pump plunger, a rotary element coupled to said plunger for rotation at speeds dependent on engine speed, a semi-fixed element having an end face disposed in camming engagement with said rotary element and allowed to make a pivotal movement through a limited angle, the rotary element being adapted to carry out simultaneous rotating and reciprocating motion to cause a corresponding simultaneous rotating and reciprocating motion of the pump plunger for suction and pressure delivery of fuel, a first hydraulic actuatable element having a predetermined pressure applying area and connected to said semi-fixed element, a second hydraulic actuatable element having a larger pressure applying area than said first hydraulic actuatable element and disposed on an extension of the axis of said first hydraulic actuatable element, means for prohibiting displacement of said second hydraulic actuatable element toward said first hydraulic actuatable element beyond a prescribed range, a first spring interposed between said two hydraulic actuatable elements and urging them in a direction opposite to each other, and a pressure source for supplying a hydraulic pressure which is a function of engine speed to said first and second hydraulic actuatable elements at pressure applying areas thereof, wherein said pressure applying areas of said first and second hydraulic actuatable elements are each arranged on end faces of the respective hydraulic actuatable elements remote from said first spring, and whereby displacement of said first hydraulic actuatable element toward said second hydraulic actuatable element causes an advance in the injection timing of the pump, the improvement comprising:

coupling means coupled to said first and second hydraulic actuatable element for permitting relative movement of said first and second hydraulic actuatable elements within a prescribed distance and for causing common movement of said first and second hydraulic actuatable elements when said prescribed distance is exceeded; and a second spring having one end arranged stationary and another end permanently urging said second hydraulic actuatable element in a direction away from said first hydraulic actuatable element;

said second hydraulic actuatable element being kept in a most biased position by said spring until said hydraulic pressure which is a function of engine speed reaches a predetermined value to bias said first hydraulic actuatable element in an injection timing advancing direction through said coupling means; and wherein the following relationships are satisfied simultaneously:

$$P(A_2-A_1)>KS$$

and $$PA_1 \geqq F$$

where $A_1$=pressure applying area of said first hydraulic actuatable element, $A_2$=pressure applying area of said second hydraulic actuatable element, P=pressure acting upon the pressure applying areas of said first and second hydraulic actuatable elements, S=maximum allowable displacement of said second hydraulic actuatable element, F=setting load of said first spring, and K=spring constant of said second spring.

2. The fuel injection pump of claim 1, wherein said coupling means comprises a rod movably arranged in a fluid-tight manner within at least one of said first and second hydraulic actuatable elements, said rod including a means for causing one of said hydraulic actuatable elements to be moved by the other hydraulic actuatable element when a prescribed distance between said two hydraulic actuatable elements is exceeded.

3. The fuel injection pump of claim 1 or 2, including a housing in which said first and second hydraulic actuatable elements are arranged, wherein said second spring has one end secured to a shoulder formed in said housing and the other end permanently urging one end face of said second hydraulic actuatable element facing said first hydraulic element.

4. The fuel injection pump of claim 1 or 2, wherein said second spring has a setting load set at a value relative to the setting load of said first spring to obtain a predetermined timing advancing characteristic with respect to engine speed.

5. The fuel injection pump of claim 1 or 2 wherein said hydraulic pressure supplied by said pressure source is proportional to engine speed.

* * * * *